US005109925A

United States Patent [19]

Stepp et al.

[11] Patent Number: 5,109,925

[45] Date of Patent: May 5, 1992

[54] MULTIPLE STAGE INFLATION PACKER WITH SECONDARY OPENING RUPTURE DISC

[75] Inventors: Lee W. Stepp, Comanche; Richard L. Giroux; Joseph B. Crump, both of Duncan, all of Okla.; Jerome F. Borges, Chesterfield, Mo.

[73] Assignee: Halliburton Company, Duncan, Okla.

[21] Appl. No.: 642,491

[22] Filed: Jan. 17, 1991

[51] Int. Cl.[5] ..... E21B 33/126; E21B 33/14

[52] U.S. Cl. ..... 166/184; 166/154; 166/187; 166/317; 166/324

[58] Field of Search ..... 166/289, 154, 187, 317, 166/318, 321, 324, 184

[56] References Cited

U.S. PATENT DOCUMENTS

| | | | |
|---|---|---|---|
| 3,228,473 | 1/1966 | Baker | 166/154 |
| 3,233,160 | 12/1965 | Baker | 166/27 |
| 3,247,905 | 4/1966 | Baker | 166/194 |
| 3,270,814 | 9/1966 | Richardson et al. | 166/21 |
| 3,366,182 | 1/1968 | Solum | 166/317 X |
| 3,524,503 | 8/1970 | Baker | 166/289 |
| 3,529,665 | 9/1970 | Malone | 166/264 |
| 3,768,556 | 10/1973 | Baker | 166/154 |
| 3,768,562 | 10/1973 | Baker | 166/289 |
| 3,811,500 | 5/1974 | Morrisett et al. | 166/154 |
| 3,948,322 | 4/1976 | Baker | 166/289 |
| 4,246,968 | 1/1981 | Jessup et al. | 166/334 |
| 4,286,662 | 9/1981 | Page, Jr. | 166/317 |
| 4,421,165 | 12/1983 | Szarka | 166/151 |
| 4,609,005 | 9/1986 | Upchurch | 166/317 X |
| 4,907,655 | 3/1990 | Hromas et al. | 166/317 X |
| 4,934,460 | 6/1990 | Coronado | 166/187 X |
| 5,024,273 | 6/1991 | Coone et al. | 166/184 |

FOREIGN PATENT DOCUMENTS

| | | | |
|---|---|---|---|
| 746085 | 7/1980 | U.S.S.R. | 166/317 |

OTHER PUBLICATIONS

Drawings TE000-0018-064-TE000-0018-069 dated Nov. , 1985, of Halliburton Services, 6 sheets.

*Primary Examiner*—Hoang C. Dang

*Attorney, Agent, or Firm*—James R. Duzan; Neal R. Kennedy

[57] ABSTRACT

A multiple stage inflation packer with secondary opening rupture disc. The inflatable packer comprises a case with a closing sleeve, an opening sleeve and a releasing sleeve therein. An opening plug is dropped into the casing string and is allowed to free fall, or is pumped down, to actuate the opening sleeve to allow inflation of the packer element. A back check valve prevents the packer from deflating. After the packer is inflated, additional pressure is applied which ruptures a rupture disc to open a port to the well annulus above the set packer element. Cementing may be carried out through this port, and after the cementing operation, a closing plug is pumped down the well casing behind the cement to actuate the releasing sleeve and move the closing sleeve to seal off the ports. Another check valve insures that pressure is equalized on both sides of the rupture disc as the packer is run into the well bore. After cementing is complete, the center of the packer may be drilled out, leaving the closing sleeve to permanently seal the ports.

20 Claims, 3 Drawing Sheets

MULTIPLE STAGE INFLATION PACKER WITH SECONDARY OPENING RUPTURE DISC

BACKGROUND OF THE INVENTION

1. Field Of The Invention

This invention relates to inflation packers used in downhole cementing, and more particularly, to an inflation packer having a rupture disc designed to burst at a predetermined pressure to allow cementing above the packer after setting thereof.

2. Description Of The Prior Art

In preparing oil well bore holes for oil and/or gas production, a most important step involves the process of cementing. Basically, oil well cementing is the process of mixing a cement-water slurry and pumping it down through steel casing to critical points located in the annulus around the casing, in the open hole below, or in fractured formations.

Cementing a well protects possible production zones behind the casing against salt water flow and protects the casing against corrosion from subsurface mineral waters and electrolysis from outside. Cementing also eliminates the danger of fresh drinking water and recreational water supply strata from being contaminated by oil or salt water flow through the bore hole from formations containing these substances. It further prevents oil well blowouts and fires caused by high pressure gas zones behind the casing and prevents collapse of the casing from high external pressures which can build up underground.

A cementing operation for protection against the above-described downhole condition is called primary cementing. Secondary cementing includes the cementing processes used in a well during its productive life, such as remedial cementing and repairs to existing cemented areas. The present invention is generally useful in both primary and secondary or remedial cementing.

In the early days of oil field production, when wells were all relatively shallow, cementing was accomplished by flowing the cement slurry down the casing and back up the outside of the casing in the annulus between the casing and the bore hole wall.

As wells were drilled deeper and deeper to locate petroleum reservoirs, it became difficult to successfully cement the entire well from the bottom of the casing, and, therefore, multiple stage cementing was developed to allow the annulus to be cemented in separate stages, beginning at the bottom of the well and working upwardly.

Multiple stage cementing is achieved by placing cementing tools, which are primarily valve ports, in the casing or between joints of casing at one or more locations in the bore hole; flowing cement through the bottom of the casing, up the annulus to the lowest cementing tool in the well; closing off the bottom and opening the cementing tool; and then flowing cement through the cement tool up the annulus to the next upper stage, and repeating this process until all the stages of cementing are completed.

There are cementing applications which necessitate the sealing off of the annulus between the casing string and the wall of the bore hole at one or more positions along the length of the casing string. An example of such an application is when it is desired to achieve cementing between a high pressure gas zone and a lost circulation zone penetrated by the bore hole. Another application is when it is desired to achieve cementing above a lost circulation zone penetrated by the bore hole. A third application occurs when formation pressure of an intermediate zone penetrated by the bore hole is greater than the hydrostatic head of the cement to be placed in the annulus thereabove. Still another application occurs when a second stage of cement is to be placed at a distant point up the hole from the top of the first stage of cement, and a packer is required to help support the cement column in the annulus. A further example of an application for employment of a cementing packer occur when it is desired to achieve full hole cementing of slotted or perforated liners.

An example of such an inflatable packer for cementing is the multiple stage inflatable packer disclosed in U.S. Pat. No. 3,948,322 to Baker, owned by the assignee of the present invention. In this device, an opening plug is dropped into the casing string and pumped down to actuate an opening sleeve to allow inflation of the packer element. A back check valve prevents the packer from deflating. After the packer is inflated, additional pressure is applied which moves an annular valve member to open a port to the well annulus above the inflated packer element. In a later version of this apparatus, a thin walled secondary opening sleeve is sheared to open this port.

Cementing is carried out through the port, and after the cementing operation, a closing plug is dropped into the well casing to actuate a releasing sleeve and move a closing sleeve which seals off the ports. After the operation is complete, the center of the tool may be drilled out, leaving the closing sleeve to permanently seal the ports.

One problem with this apparatus is that the secondary opening sleeve, being essentially a thin walled mandrel, is difficult to manufacture. Further, when the tool is positioned in the well bore, there may be some bending of the tool which can cause the annular valve member or secondary opening sleeve to bind and not open as desired.

The present invention solves this problem by replacing the annular valve member or secondary opening sleeve with a secondary rupture disc which is designed to burst or rupture at the predetermined pressure.

SUMMARY OF THE INVENTION

The multiple stage inflation packer with secondary opening rupture disc of the present invention comprises case means for connecting to a casing string defining a port therethrough, inflatable packing means which is connected to the case and in communication with the port in the case for sealingly engaging the well bore when inflated, and rupture means upstream of the inflatable packing means for rupturing in response to a predetermined pressure after inflation of the packing means and thereby placing the port in communication with the well annulus so that a cementing operation above the packing means may be carried out. This packer apparatus may further comprise opening means for placing the port in communication with a central opening through the apparatus whereby fluid pumped into the central opening is directed through the port to the packer means for inflation thereof and closing means for sealingly closing the port with respect to the central opening after rupturing of the rupture means.

Check valve means may be provided between the port and the packing means for allowing movement of fluid to the packing means while preventing reverse flow and deflation of the packing means.

The rupture means is preferably characterized by a rupture disc adapted for rupturing at the predetermined pressure. The rupture means further comprises housing means for positioning around the case means and disc retaining means for engaging the housing means and retaining the rupture means therein. In the preferred embodiment, the disc retaining means is characterized by a disc retainer threadingly engaged with the housing means. The rupture disc may be fixedly attached to the disc retainer, such as by brazing or welding.

The packer further comprises pressure equalizing means for equalizing a pressure adjacent to an inner side or inwardly facing surface of the rupture means with a well annulus pressure. This pressure equalizing means may comprise check valve means for allowing fluid flow from the well annulus to the inner side or inwardly facing surface of the rupture means while preventing reverse flow to the well annulus. Filtering means may also be provided for filtering the fluid flow from the well annulus prior to contact with the check valve means and the pressure equalizing means.

The opening means may be characterized by an opening sleeve of a kind known in the art which initially closes the port in the case means with respect to the central opening. The opening sleeve may be moved to a position opening the case port to the central opening by dropping an opening plug through the casing string to engage the opening sleeve.

The closing means may be characterized by a closing sleeve of a kind known in the art and disposed in the case means. The closing sleeve defines a sleeve port therethrough initially substantially aligned with the port in the case means, and the closing sleeve is movable to a position closing the port in the case means. The closing means further comprises a releasing sleeve, also of a kind known in the art, disposed in the closing sleeve and adapted for initially holding the closing sleeve in engagement with the case means. The releasing sleeve is movable by dropping a closing plug through the casing to engage the releasing sleeve, and after movement of the releasing sleeve, the closing sleeve is moved to the position closing the port in the case means.

An important object of the present invention is to provide a multiple stage inflation packer with rupture means for allowing cementing of a well annulus above the packer element after the packer element inflated.

Another object of the invention is to provide an inflatable packer with a secondary opening rupture disc for use in multiple stage cementing operations.

Additional objects and advantages of the invention will become apparent a the following detailed description of the preferred embodiment is read in conjunction with the drawings which illustrate such preferred embodiment.

DESCRIPTION OF THE PREFERRED EMBODIMENT

Figure 1A:
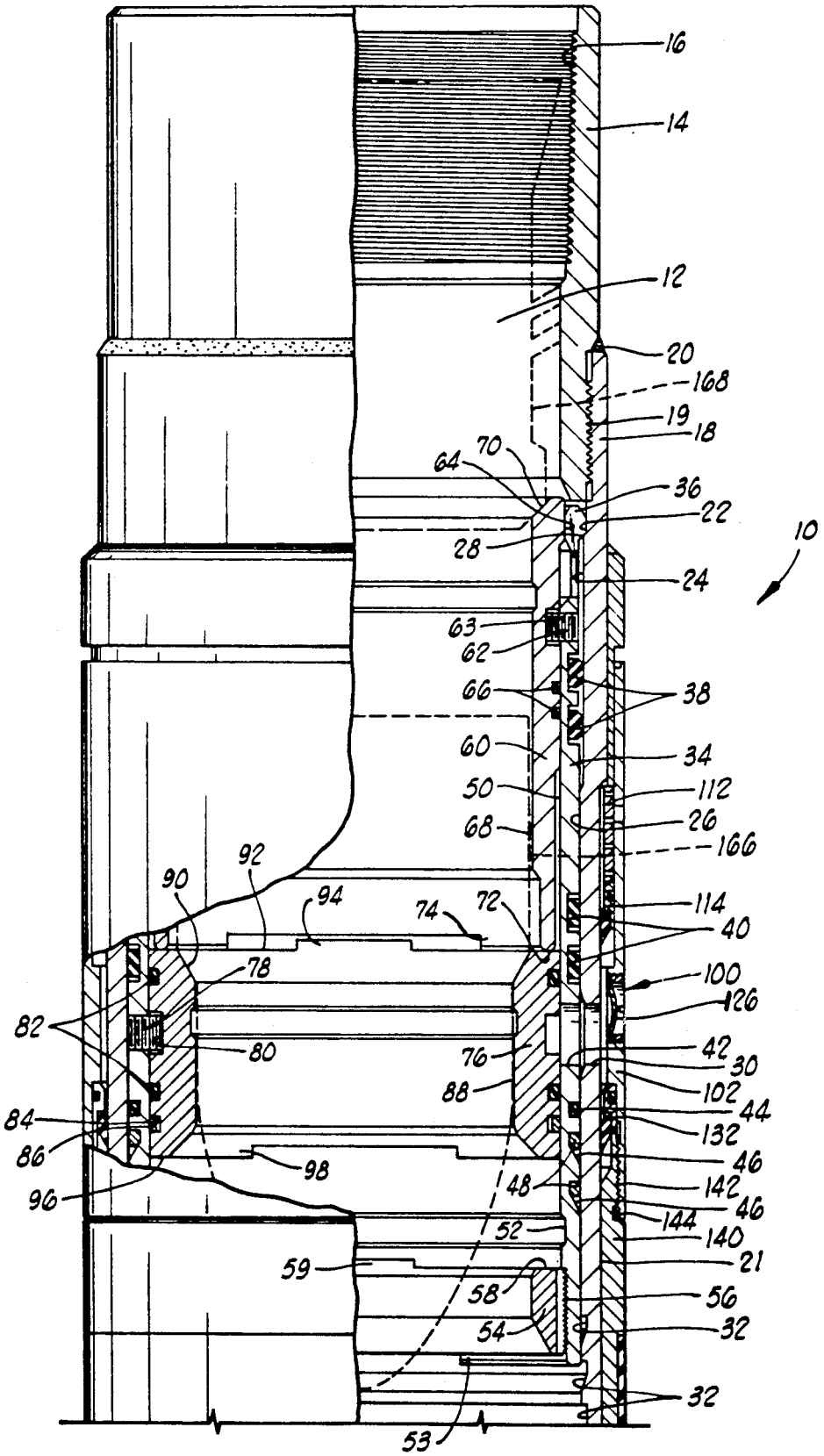
FIGS. 1A and 1B show a partial elevation and longitudinal cross section of the multiple stage inflation packer with rupture disc of the present invention.
Figure 1B:
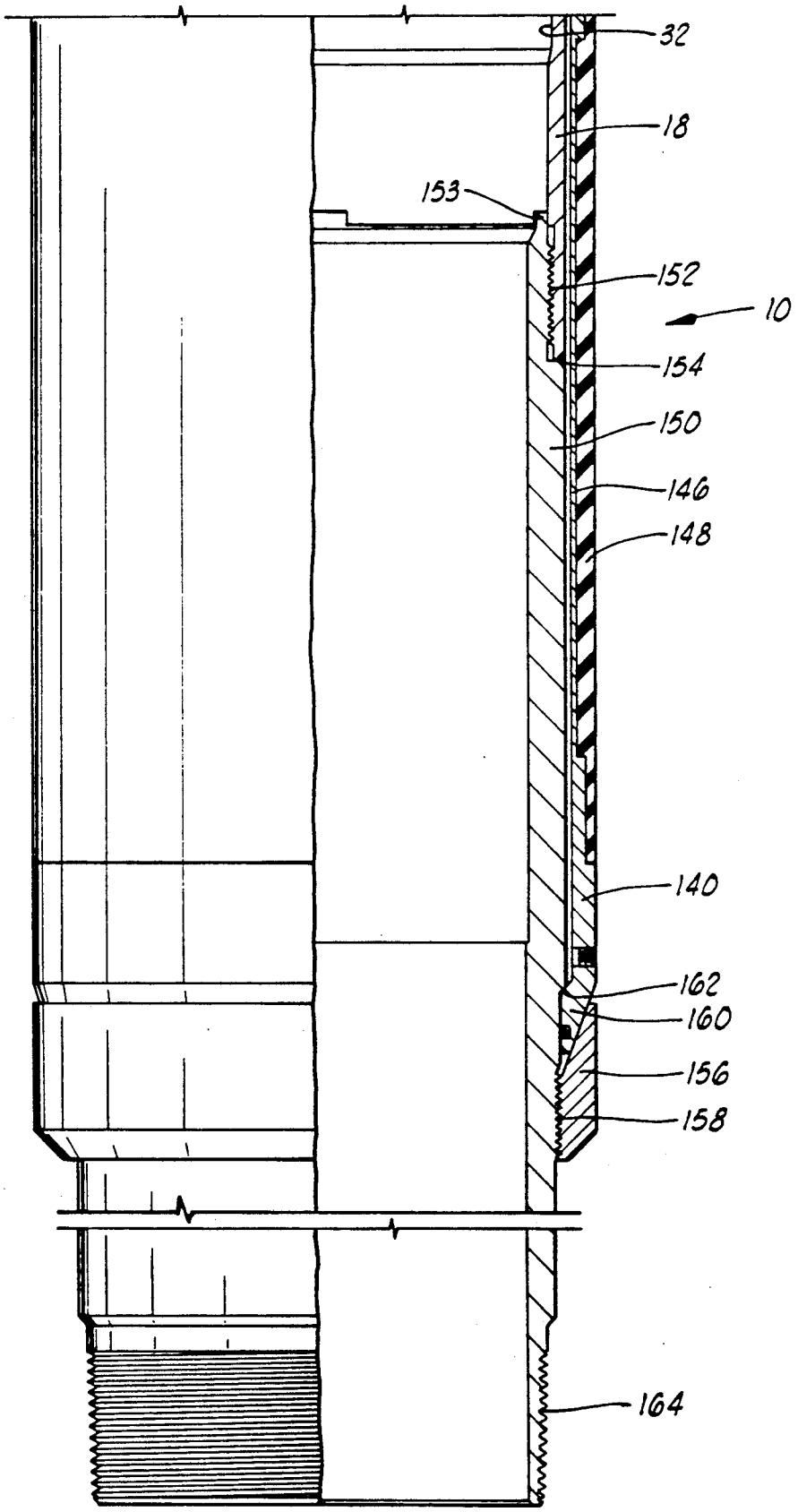

Referring now to the drawings, and more particularly to FIGS. 1A and 1B, the multiple stage inflation packer with rupture disc of the present invention is shown and generally designated by the numeral 10. Packer 10 has a central opening 12 therethrough and is designed for use in a well casing where multiple stage cementing is desired.

At the top of packer 10 is an upper body 14 having an internally threaded surface 16 therein. Threaded surface 16 is adapted for engagement with an upper portion of the casing string (not shown). The lower end of upper body 14 is attached to case 18 at threaded connection 19. A fastening means, such as weld 20, prevents disengagement of case 18 and upper body 14.

Case 18 has an outer surface 21 thereon.

Case 18 defines a first bore 22, a second bore 24 and a third bore 26 therein which are progressively smaller. Extending between first bore 22 and second bore 24 is a small annular shoulder 28.

A transverse port 30 is defined through case 18 and is in communication with third bore 26 thereof. Below transverse port 30, a plurality of locking ring grooves 32 are defined in third bore 26.

A closing sleeve 34 is disposed in an upper portion of case 18. At the upper end of closing sleeve 34 are a plurality of upwardly extending collet fingers 36 which form a part of closing sleeve 34. Initially, collet fingers 36 are disposed in first bore 22 of case 18 and lockingly engaged with shoulder 28 in the case as further described herein.

Below collet fingers 28, an upper sealing means, such as a pair of upper seals 38, is disposed between closing sleeve 34 and case 18. Below the upper sealing means is a lower sealing means, such as a pair of lower seals 40, which provides sealing engagement between closing sleeve 34 and third bore 26 in case 18.

Closing sleeve 34 defines a substantially transverse port 42 therethrough which is initially substantially aligned with port 30 in case 18. Below port 42, another sealing means, such as O-ring 44, provides sealing engagement between closing sleeve 34 and case 18.

Below O-ring 44, closing sleeve 34 defines a plurality of outwardly facing locking ring grooves 46 therein. In each locking ring groove is an inherently outwardly biased locking ring 48.

Closing sleeve 34 has a bore 50 therethrough with a locking ring groove 52 defined in the lower end thereof. At the bottom of closing sleeve 34 are a plurality of lugs 53.

A seat retainer 54 is attached to the lower end of closing sleeve 34 at threaded connection 56. Seat retainer 54 has a upper end 58 which generally forms an upwardly facing annular shoulder within closing sleeve 34. A plurality of lugs 59 are formed on upper end 58.

A releasing sleeve 60 is disposed in bore 50 of closing sleeve 34 and initially affixed thereto by one or more shear pins 62 which extend into corresponding holes 63 in the releasing sleeve. At the upper outer end of releasing sleeve 60 is a radially outwardly extending flange 64. Flange 64 initially engages collet fingers 36 so that the collet fingers cannot flex inwardly. It will be seen by those skilled in the art that closing sleeve 34 is thus locked with respect to case 18.

A sealing means, such as a pair of O-rings 66, prevent cement from flowing between releasing sleeve 60 and closing sleeve 34.

Releasing sleeve 60 defines a bore 68 therein with a chamfer 70 at the upper end thereof. Releasing sleeve 60 has a lower end 72 with a plurality of lugs 74 formed therein.

Below releasing sleeve 60 in bore 50 of closing sleeve 34 is an opening sleeve 76. A shear pin 78 initially holds opening sleeve 76 to closing sleeve 34. Shear pin 78 extends into a shear pin hole 80 in the outer surface of opening sleeve 76. There may be a plurality of shear pins 78 and corresponding holes 80.

A sealing means, such as a pair of O-rings 82, provides sealing engagement between opening sleeve 76 and bore 50 of closing sleeve 34. It will be seen that O-rings 82 are positioned on opposite sides of port 42 in closing sleeve 34, thereby sealingly closing port 42 with respect to central opening 12 when in the initial position shown in FIG. 1A.

Below lower O-ring 82, opening sleeve 76 defines an outwardly facing locking ring groove 86 An inherently outwardly biased locking ring 86 is disposed in locking ring groove 84.

Opening sleeve 76 has a bore 88 therethrough with a chamfer 90 at the upper end thereof.

An upper end 92 of opening sleeve 76 has a plurality of lugs 94 extending upwardly therefrom. Lugs 94 on opening sleeve 76 generally extend between lugs 74 on releasing sleeve 60.

Lower end 96 of opening sleeve 76 has a plurality of lugs 98 formed thereon. As will be further discussed herein, lugs 98 are adapted to receive lugs 59 on seat retainer 54 therebetween when opening sleeve 76 is actuated.

Figure 2:
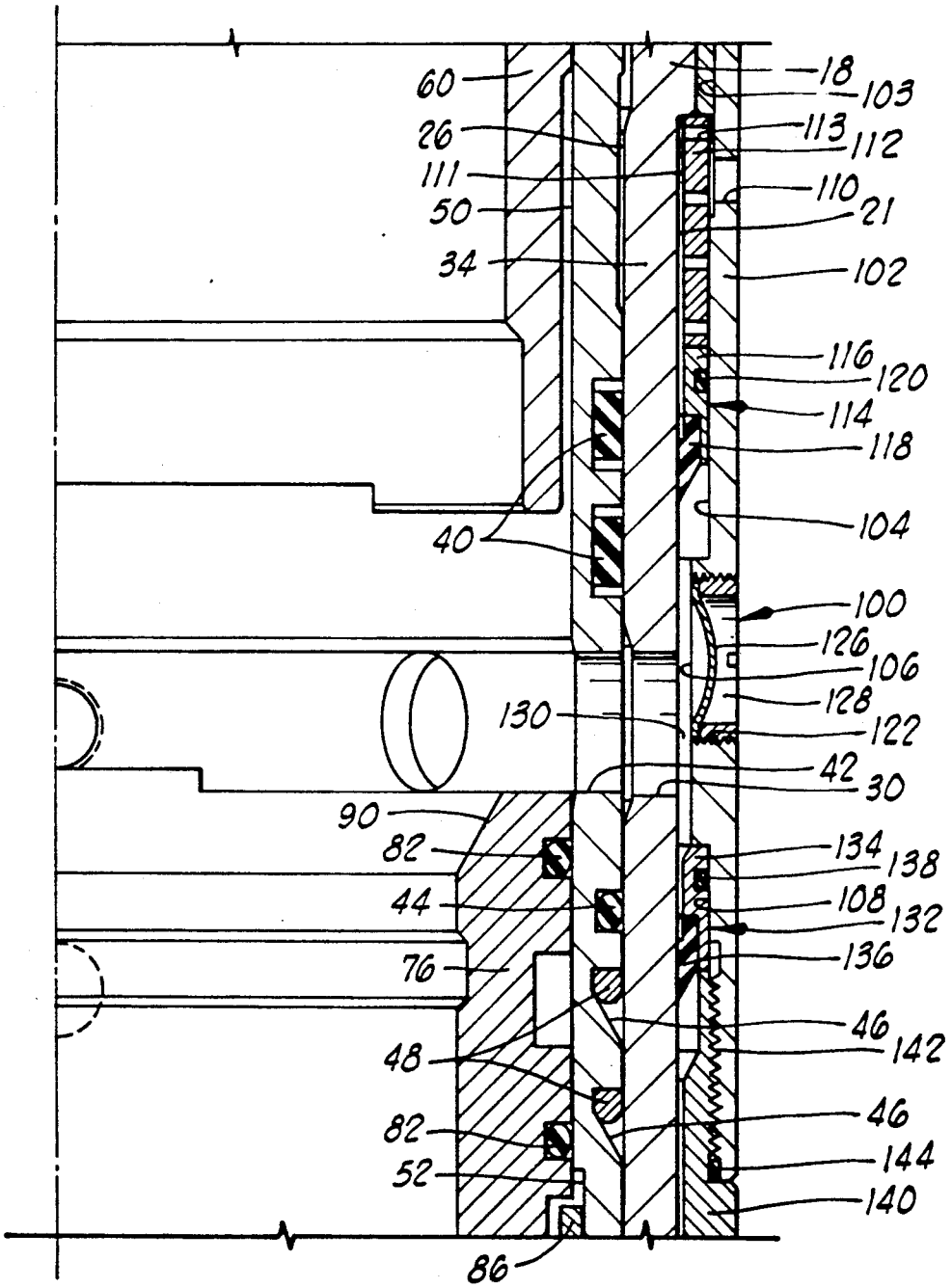
FIG. 2 is an enlarged portion of FIG. 1A which shows the rupture disc and adjacent components in more detail.

Disposed around outer surface 21 of case 18 is a rupture disc/check valve assembly 100. Referring now also to FIG. 2, the details of rupture disc/check valve assembly 100 will be discussed.

Rupture disc/check valve assembly 100 comprises a housing 102, also referred to as a bladder extension 102. Housing 102 has a first bore 103, second bore 104, third bore 106 and a fourth bore 108. A substantially transverse port 110 is defined through housing 102 and is in communication with first bore 103.

Disposed between outer surface 21 of case 18 and first and second bores 103 and 104 of housing 102 is a sleeve-like filter or spacer 112. Filter 112 defines a bore 111 therethrough which is spaced radially outwardly from outer surface 21 of case 18. Filter 112 also defines a plurality of radial holes 113 therethrough. It will be seen that at least some of holes 113 are in communication with port 110 and housing 102.

Below filter 112 is an upper check valve 114. Upper check valve 114 is of a kind known in the art and comprises a check valve body 116 and an elastomeric check valve element 118. A sealing means, such as O-ring 120, provides sealing engagement between check valve body 116 and second bore 104 in housing 102.

Below check valve 114, housing 102 defines a threaded opening 122 therein. A rupture disc 126 is attached to a rupture disc retainer 128 by a means such as brazing or welding, and rupture disc retainer 128 is preferably threaded into threaded opening 122. Thus, rupture disc 126 is positioned adjacent to third bore 106 in housing 102.

Third bore 106 is spaced outwardly from outer surface 21 of case 18 so that an annular volume 130 is defined therebetween. It will be seen by those skilled in the art that rupture disc 126 is thus in communication with port 30 in case 18.

Below port 30 and rupture disc 128 is a lower check valve 132 disposed between fourth bore 108 of housing 102 and outer surface 21 of case 18. Lower check valve 132 is substantially identical to upper check valve 114 and comprises a check valve body 134 and an elastomeric check valve element 136. A sealing means, such as O-ring 138, provides sealing engagement between check valve body 134 and fourth bore 108 in housing 102.

Referring again to FIG. 1A, the lower end of housing 102 is attached to an inflatable bladder packer assembly 140 at threaded connection 142. It will be seen that the upper end of packer assembly 140 prevents downward movement of lower check valve 132. Sealing engagement is provided between packer assembly 140 and housing 102 by a sealing means, such as O-ring 144.

Referring to FIG. 1B, packer assembly 140 is of a kind known in the art and has a thin metal portion 146 around which is disposed an elastomeric packer element 148.

The lower end of case 18 is attached to a lower body 150 at threaded connection 152. Lower body 150 has an upwardly facing plurality of lugs 153 thereon. Case 18 and lower body 150 are further attached by such means as a weld 154 to form an integral structure. Alternatively, case 18 initially could be made as a single piece.

A packer shoe 156 is attached to lower body 150 at threaded connection 158. Packer shoe 156 clamps a lower end 160 of packer assembly 140 to a shoulder 162 on lower body 150.

The lower end of lower body 150 has an externally threaded surface 164 thereon which is adapted for connection to a lower portion of the casing string (not shown).

OPERATION OF THE INVENTION

Inflatable packer 10 is made up as part of the casing string which is run into the well bore in a manner known in the art. Packer 10 is in the configuration shown in FIGS. 1A and 1B when run into the well bore.

As packer 10 is run into the hole, the pressure in the well annulus and the pressure in central opening 12 of the packer collar is equalized through upper check valve 114. Fluid in the well bore will pass through the filter 112 and upper check valve 114. This prevents premature rupturing of rupture disc 126. Filter 112 prevents debris from entering the check valves or packer assembly 140.

Cementing of the first or bottom stage below packer collar 10 is carried out in a manner known in the art. This places cement between the casing and the well bore at a location below packer 10.

After the first stage cementing operation is completed, a free fall opening plug 166 (shown in dashed lines in FIG. 1A) of a kind known in the art is dropped into the casing and allowed to free fall, or is pumped down, to opening sleeve 76. Opening plug 166 engages chamfer 90 in opening sleeve 76.

Pressure is then applied in the casing which forces opening plug 166 against opening sleeve 76, thereby shearing shear pin 78 and moving opening sleeve 76 downwardly until lower end 96 thereof contacts upper end 58 of seat retainer 54. At this point, locking ring 86 will snap radially outwardly to engage locking groove 52 in closing sleeve 34. Locking ring 86 still at least partially engages opening sleeve 76 so that the opening sleeve cannot move upwardly. This position of opening sleeve 76 is shown in FIG. 2, and it will be seen by those skilled in the art, that port 42 in closing sleeve 34 is thus opened and placed in communication with central opening 12 in packer 10.

As casing pressure is increased, fluid passes from central opening 12 through ports 42 and 30 into annular volume 130. The fluid flows past lower check valve 132 into packer assembly 140. Lower check valve 132 insures that there is no back flow of fluid out of packer assembly 140. As packer assembly 140 inflates, metal portion 146 thereof is deflected radially outwardly so that packer element 148 is brought into sealing engagement with the well bore. As this occurs, housing 102, and thus all of rupture disc/check valve assembly 100, are moved downwardly along outer surface 21 of case 18 When packer assembly 140 is fully inflated and in sealing engagement with the well bore, rupture disc 126 will be substantially aligned with port 30 in case 18. It will be seen that rupture disc/check valve assembly 100 is upstream of packer assembly 140 with regard to inflation of the packer assembly.

When the pressure in the casing, and thus in central opening 12 of packer 10, reaches a predetermined level, rupture disc 126 will rupture outwardly. It will be seen that this places port 42 in closing sleeve 34 and port 30 in case 18 in communication with the well annulus. The second stage cementing operation may then be carried out by pumping cement downwardly into packer collar 10. Because of the presence of opening plug 166, all of the cement will be directed through ports 42 and 30, then through the opening caused by the rupture disc 126, and finally into the well annulus. After rupture disc 126 has opened, this cementing operation is substantially the same a that previously known in the art.

Once the second stage cementing operation is completed, a closing plug 168 (shown in dashed lines in FIG. 1A) of a kind known in the art is positioned in the casing and pumped down to contact chamfer 70 on releasing sleeve 60. Pressure is applied to the casing which forces closing plug 168 against releasing sleeve 60 and thereby shearing shear pin 62. Releasing sleeve 60 is then moved downwardly until lower end 72 thereof contacts upper end 92 on opening sleeve 76.

Once releasing sleeve 60 is moved downwardly, collet fingers 36 on closing sleeve 34 are no longer prevented from being flexed inwardly. Thus, additional downward force on releasing sleeve 60 will bear against opening sleeve 76 and seat retainer 54. It will be seen by those skilled in the art, that this applies a downward force on closing sleeve 34. Collet fingers 36 will flex inwardly to clear shoulder 28 so that closing sleeve 34 is also moved downwardly until it contacts lower body 150.

When closing sleeve 34 is thus moved, lower seals 40 are moved below port 30 in case 18. Upper seals 38 are still above port 30, and upper seals 38 are sealingly engaged with third bore 26 in case 18. Port 30 thus is sealingly closed by closing sleeve 34.

Also when closing sleeve 34 is moved downwardly, locking rings 48 in locking ring grooves 46 in closing sleeve 34 will become aligned with locking ring grooves 32 in case 18. Locking rings 48 will expand outwardly to engage grooves 32 while remaining partially engaged with grooves 46. Thus, closing sleeve 34 is locked to prevent upward movement thereof.

After completion of this operating cycle, closing plug 168, opening plug 166 and at least a portion of releasing sleeve 60, opening sleeve 76 and seat retainer 54 may be drilled out to open the casing string. The interaction of lugs 74 on releasing sleeve 60 with lugs 94 on opening sleeve 76, the interaction between lugs 98 on opening sleeve 76 and lugs 59 on seat retainer 54, and the interaction between lugs 53 on closing sleeve 34 with lugs 153 on lower body 150 prevent rotation of the components during the drilling process. Closing sleeve 34 should remain so that ports 30 in case 18 remain sealingly closed.

It will be seen, therefore, that the multiple stage inflation packer with rupture disc of the present invention is well adapted to carry out the ends and advantages mentioned, as well as those inherent therein. While a presently preferred embodiment of the apparatus has been shown for the purposes of this disclosure, numerous changes in the arrangement and construction of parts may be made by those skilled in the art. All such changes are encompassed within the scope and spirit of the appended claims.

What is claimed is:

1. An inflatable packer apparatus for use in a well bore, said packer comprising:

case means for connecting to a casing string and defining a port therethrough;

inflatable packing means, connected to said case means and in communication with said port, for sealingly engaging the well bore when inflated; and rupture means upstream of said inflatable packing means for rupturing in response to a predetermined pressure after inflation of said packing means and thereby placing said port in communication with a well annulus.

2. The apparatus of claim 1 further comprising:

opening means for placing said port in communication with a central opening through the apparatus whereby fluid pumped into said central opening is directed through said port to said packing means for inflation thereof; and closing means for sealingly closing said port with respect to said central opening after rupturing of said rupture means.

3. The apparatus of claim 1 further comprising check valve means between said port and said packing means for allowing movement of fluid to said packing means while preventing deflation thereof.

4. The apparatus of claim 1 wherein said rupture means is characterized by a rupture disc adapted for rupturing at said predetermined pressure.

5. The apparatus of claim 4 wherein said rupture means further comprises:

housing means for positioning around said case means; and disc retaining means for engaging said housing means and retaining said rupture disc therein.

6. The apparatus of claim 5 wherein said disc retaining means is characterized by a disc retainer threadingly engaged with said housing means.

7. The apparatus of claim 6 wherein said rupture disc is fixedly attached to said disc retainer.

8. An inflatable packer apparatus for use in a well bore, said packer apparatus comprising:

case means for connecting to a casing string and defining a port therethrough;

inflatable packing means, connected to said case means and in communication with said port, for sealingly engaging the well bore when inflated;

rupture means for rupturing in response to a predetermined pressure after inflation of said packing means and thereby placing said port in communication with a well annulus; and pressure equalizing means for equalizing an pressure adjacent to an inner side of said rupture means with a well annulus pressure.

9. The apparatus of claim 8 wherein said pressure equalizing means comprises check valve means for allowing fluid flow from said well annulus to said inner side of said rupture means while preventing reverse flow to said well annulus.

10. The apparatus of claim 9 further comprising filtering means for filtering said fluid flow prior to contact with said check valve means.

11. A multiple stage inflation packer for use in cementing a casing string in a well bore, said packer comprising:

a case attachable to upper and lower casing string portions and defining a central opening therethrough with a case port in communication with said central opening;

an inflatable packer assembly disposed around a portion of said case, said packer assembly being adapted for inflation from fluid pumped from said central opening through said case port;

a closing sleeve disposed in said case and defining a sleeve port therethrough initially substantially aligned with said case port, said closing sleeve being movable to a position closing said case port;

a releasing sleeve disposed in said closing sleeve and adapted for initially holding said closing sleeve in engagement with said case;

an opening sleeve disposed in said closing sleeve and initially closing said case port and sleeve port with respect to said central opening of said case, said opening sleeve being movable to a position opening said case port and sleeve port with respect to said central opening;

a housing disposed around said case adjacent to said case port, said housing defining an opening therethrough; and a rupture disc disposed in said housing opening, said rupture disc being adapted for rupturing in response to a predetermined pressure applied thereto;

wherein:

when said opening sleeve is moved to said position opening said case port and sleeve port fluid may be pumped through said case port and sleeve port from said central opening for inflating said packer assembly;

after inflation of said packer assembly cement may be pumped from said central opening of said case through said sleeve port, case port, ruptured rupture disc and housing opening into a well annulus above the inflated packer assembly; and said releasing sleeve is movable such that said closing sleeve may be moved to said position closing said case port after completion of cementing.

12. The apparatus of claim 11 further comprising a check valve disposed between said housing and said case for allowing flow from said case port to said inflatable packer assembly while preventing reverse flow of fluid from said packer assembly.

13. The apparatus of claim 11 further comprising a disc retainer for retaining said rupture disc in said housing opening.

14. The apparatus of claim 13 wherein said disc retainer is threadingly engaged with said housing.

15. The apparatus of claim 13 wherein said disc retainer is fixedly attached to said rupture disc.

16. The apparatus of claim 11 wherein an annular volume is defined between said case and housing and said rupture disc is disposed adjacent to an outer portion of said annular volume.

17. The apparatus of claim 11 wherein said housing is adapted for sliding along an outer surface of said case as said packing assembly is inflated.

18. A multiple stage inflation packer for use in cementing a casing string in a well bore, said packer comprising:

a case attachable to upper and lower casing string portions and defining a central opening therethrough with a case port in communication with said central opening;

an inflatable packer assembly disposed around a portion of said case, said packer assembly being adapted for inflation from fluid pumped from said central opening through said case port;

a closing sleeve disposed in said case and defining a sleeve port therethrough initially substantially aligned with said case port, said closing sleeve being movable to a position closing said case port;

a releasing sleeve disposed in said closing sleeve and adapted for initially holding said closing sleeve in engagement with said case;

an opening sleeve disposed in said closing sleeve and initially closing said case port and sleeve port with respect to said central opening of said case, said opening sleeve being movable to a position opening said case port and sleeve port with respect to said central opening;

a housing disposed around said case adjacent to said case port, said housing defining an opening therethrough and also defining a housing port therethrough; and a rupture disc disposed in said housing opening, said rupture disc being adapted for rupturing in response to a predetermined pressure applied thereto;

wherein:

when said housing sleeve is moved to said position opening said case port and sleeve port fluid may be pumped through said case port and sleeve port from said central opening for inflating said packer assembly;

after inflation of said packer assembly cement may be pumped from said central opening of said case port through said sleeve port, case port, ruptured rupture disc and housing opening into a well annulus above the inflated packer assembly;

said releasing sleeve is movable such that said closing sleeve may be moved to said position closing said case port after completion of cementing; and said housing port is in communication with an inwardly facing portion of said rupture disc whereby pressure on said inwardly facing portion of said rupture disc is equalized with a well annulus pressure.

19. The apparatus of claim 18 further comprising a check valve disposed between said housing port and said inner portion of said rupture disc whereby fluid may flow from said well annulus to said inner portion of said rupture disc while reverse flow is prevented.

20. The apparatus of claim 19 further comprising a filter disposed between said housing port and said check valve.

* * * * *